United States Patent [19]

Staley et al.

[11] Patent Number: 4,657,307

[45] Date of Patent: Apr. 14, 1987

[54] CONCRETE PAVEMENT BREAKER

[75] Inventors: Charles L. Staley; John R. Harms; Ronald L. Anderson, all of Burlington, Iowa

[73] Assignee: J. I. Case Company, Racine, Wis.

[21] Appl. No.: 809,044

[22] Filed: Dec. 16, 1985

[51] Int. Cl.[4] ..... E01C 23/12

[52] U.S. Cl. ..... 299/36; 404/90

[58] Field of Search ..... 299/36, 37, 67, 15; 404/90, 91; 414/724; 125/23 R; 225/103, 104; 37/2 R, 2 P

[56] References Cited

U.S. PATENT DOCUMENTS

| | | | |
|---|---|---|---|
| 910,922 | 1/1909 | Kerns | 299/15 |
| 2,857,690 | 10/1958 | Yake et al. | 37/2 R |
| 2,878,002 | 3/1959 | Haley | 299/36 |
| 3,542,435 | 11/1970 | Herrmann | 299/36 |
| 4,153,301 | 5/1979 | Armstrong | 299/36 |

FOREIGN PATENT DOCUMENTS

| | | | |
|---|---|---|---|
| 344994 | 3/1931 | United Kingdom | 404/90 |

*Primary Examiner*—James A. Leppink
*Assistant Examiner*—Michael A. Goodwin
*Attorney, Agent, or Firm*—Peter N. Jansson

[57] ABSTRACT

An improved simple device for loosening, breaking up and removing concrete pavement slabs. The device has one or more planar vertical engagement members each having a generally horizontal slab-receiving slot. Each slot is bounded by upper and lower opposed edges and a crotch edge therebetween, all in fixed relative positions. The upper and lower edges extend forwardly to aligned upper and lower forward ends. The slot is dimensioned to accept and manipulate slabs, and to lift slab pieces taking advantage of the weight of the slabs to hold them for lifting. First and second pivot-mounting means are arranged to facilitate a can-opener like slab-manipulating motion.

14 Claims, 5 Drawing Figures

CONCRETE PAVEMENT BREAKER

FIELD OF THE INVENTION

This invention is related generally to apparatus for removing concrete pavement and, more particularly, to concrete pavement breakers of the type having means for engaging opposed surfaces of pavement slabs.

BACKGROUND OF THE INVENTION

In the prior art there are a number of devices which have been developed to break concrete pavement. The devices of the prior art have a number of disadvantages or drawbacks.

Some examples of prior art devices are disclosed in U.S. Pat. Nos. 2,878,002 (Haley), 3,980,341 (Musannif et al.), 3,542,435 (Herrmann), 2,388,461 (Baker), 3,349,933 (Simpson et al.), 4,217,000 (Watanabe), 4,153,301 (Armstrong), and 819,142 (Kerns).

Concrete pavement breaking apparatus of the prior art is often dedicated apparatus which is complex in structure. Such devices often include powered elements, either hydraulic or pneumatic, to assist in concrete breaking or manipulating. Such equipment, in many cases, is difficult to operate and slow in operation. In other cases, the capabilities of such apparatus are limited. The Haley, Musannif et al., Herrmann, Watanabe and Armstrong devices are examples of such equipment.

The prior art also includes some simple concrete removal tools which may be attached to power equipment of various kinds. These devices, however, are very limited in their capabilities, and are mainly used to pry up concrete slabs for subsequent destruction or removal. Examples of devices are disclosed in the Kerns, Baker and Simpson et al. patents.

There is a need for a simple and inexpensive device which can efficiently break up concrete. Furthermore, there is a need for equipment of this type which can also operate to lift broken concrete slabs for removal from the worksite.

BRIEF SUMMARY OF THE INVENTION

This invention is an improved device for breaking and removing concrete pavement. The improved concrete breaking and removing device of this invention overcomes some problems and deficiencies of the prior art, including those which are mentioned above.

The invention includes a pavement engagement member having a slab-receiving slot. The engagement member preferably is a generally planar, thin, solid, vertical steel member. The slot is bounded by upper and lower opposed edges, which are preferably parallel, and a crotch edge defining the closed end of the slot. The crotch edge is preferably semi-circular in shape.

The upper, lower and crotch edges are in fixed relative positions. The upper and lower edges extend forwardly from the crotch edge to terminate in upper and lower forward ends which are generally aligned.

The spacing between the upper and lower edges of the slot exceeds the thickness of typical concrete slabs to be removed. And, the slot is relatively deep from its open end to its closed end. Dimensioning of the slot, including the relationship of the slot depth to the spacing between its upper and lower edges, is important to how it functions.

More specifically, the distance between the crotch edge and the upper and lower forward ends exceeds the spacing between the upper and lower edges. Indeed, the distance between the crotch edge and the forward ends of the upper and lower edges preferably exceeds one and one-half times the spacing between the upper and lower edges. In the most preferred embodiments of this invention, the distance between the crotch edge and the ends is about twice the spacing between the upper and lower edges.

There are first and second pivot-mounting means on the engagement member. The placement of such pivot-mounting means and their placement relative one to another are important to the functioning of the device of this invention, in both its concrete breaking and concrete removing operations. The second pivot-mounting means is above the upper edge of the slot and forward of the first pivot-mounting means. The first pivot-mounting means is preferably to the rear of the crotch edge.

Attached to the vertical engagement member at a position rearwardly of the crotch edge is a mounting member. The first pivot-mounting means is on such mounting member. Such mounting member is preferably a bracket dimensioned for replacement mounting on power equipment.

In a highly preferred form, the device of this invention can replace the bucket of a backhoe. In describing the operation of this invention, the device will be described as mounted in the place of a backhoe bucket. The device of this invention, however, may also be used as a replacement member on a variety of other types of equipment, including front loaders.

It is necessary that the equipment on which the device of this invention is used have a primary pivoting-mount on a first arm, for attachment to the first pivot-mounting means, and a secondary pivoting-mount on a second arm, for attachment to the second pivot-mounting means. It is also necessary that the second arm be extendable with respect to the first arm.

In operation, the engagement member of this invention is supported with the slot horizontal and facing forward. The first and second arms of a backhoe support the engagement member in such position. By relative extension of the second arm, the slot is tipped downwardly at its open end, and by movement of the first and second arms together, the engagement member may move downwardly in such orientation.

In this way, and/or by movement of the vehicle, the engagement member will be brought into engagement with an edge of the pavement slab to be broken up and removed. The precise motions necessary to engage the pavement edge will depend on a number of factors, including the condition and configuration of the pavement to be removed.

After the engagement member receives an edge of the slab, the engagement member may be rocked such that the slot moves between a horizontal orientation and orientations tipped on either side of horizontal. This motion, which may or may not be combined with a general forward motion, is much like the motion of an old-style, hand-operated can opener. Stress is placed on the slab alternately by the upper edge and lower edge, and by the crotch edge, to cause the slab to break.

The fact that the spacing between the upper and lower edges of the slot is limited compared to the depth of the slot, allows a great deal of pressure to be exerted on the slab, as the weight of the slab itself is utilized in a binding locking motion. In spite of the simplicity of the engagement member and the slot formed therein, it functions quickly and efficiently to break up a concrete slab.

Furthermore, after the slab has been broken, it may readily be picked up by the same engagement member which has just broken it. A large piece of broken concrete slab will be held in the slot by virtue of the fact that the center of gravity of such slab is beyond the ends of the slot and the end of the lower edge functions as a fulcrum, causing the portion of the slab which is within the slot to bear against the upper edge sufficiently to bind it in place as the arms of the backhoe lift it away from the loadbed.

In a highly preferred form, there are two substantially identical engagement members arranged in parallel planes and having aligned parallel slots. Such engagement members are supported in spaced relation by one or more cross members. The first and second pivot-mounting means, previously described, may be on such cross members.

This two-slotted device may be mounted in the place of a single backhoe bucket. Such two-slotted devices are particularly useful when removing, as well as breaking, broken concrete pavement slabs. The two-slotted device provides greater stability in lifting a piece of broken pavement.

The device of this invention, either in its single or double form, requires no separate pneumatic, hydraulic or other apparatus or control. It may use the standard controls of a backhoe or other power machinery. Unlike the complex devices of the prior art, the operation of this invention is simple and efficient. And, unlike the simple attachment devices of the prior art, the device of this invention can efficiently lift, break up and remove concrete pavement slabs.

OBJECTS OF THE INVENTION

It is an object of this invention to provide an improved device for loosening, breaking up, and then removing concrete pavement.

Another object of this invention is to provide an efficient concrete slab breaker which may also be used to remove broken slabs from the work site.

Another object of this invention is to provide a simple but effective concrete slab breaker/remover not requiring dedicated power attachments.

Another object of this invention is to provide a simple and effective concrete slab breaker/remover which can be mounted on and manipulated by standard earth-moving equipment.

These and other objects of this invention will be apparent from this disclosure including the following additional descriptions and the drawings, wherein:

DETAILED DESCRIPTION OF PREFERRED EMBODIMENTS

Figure 5:
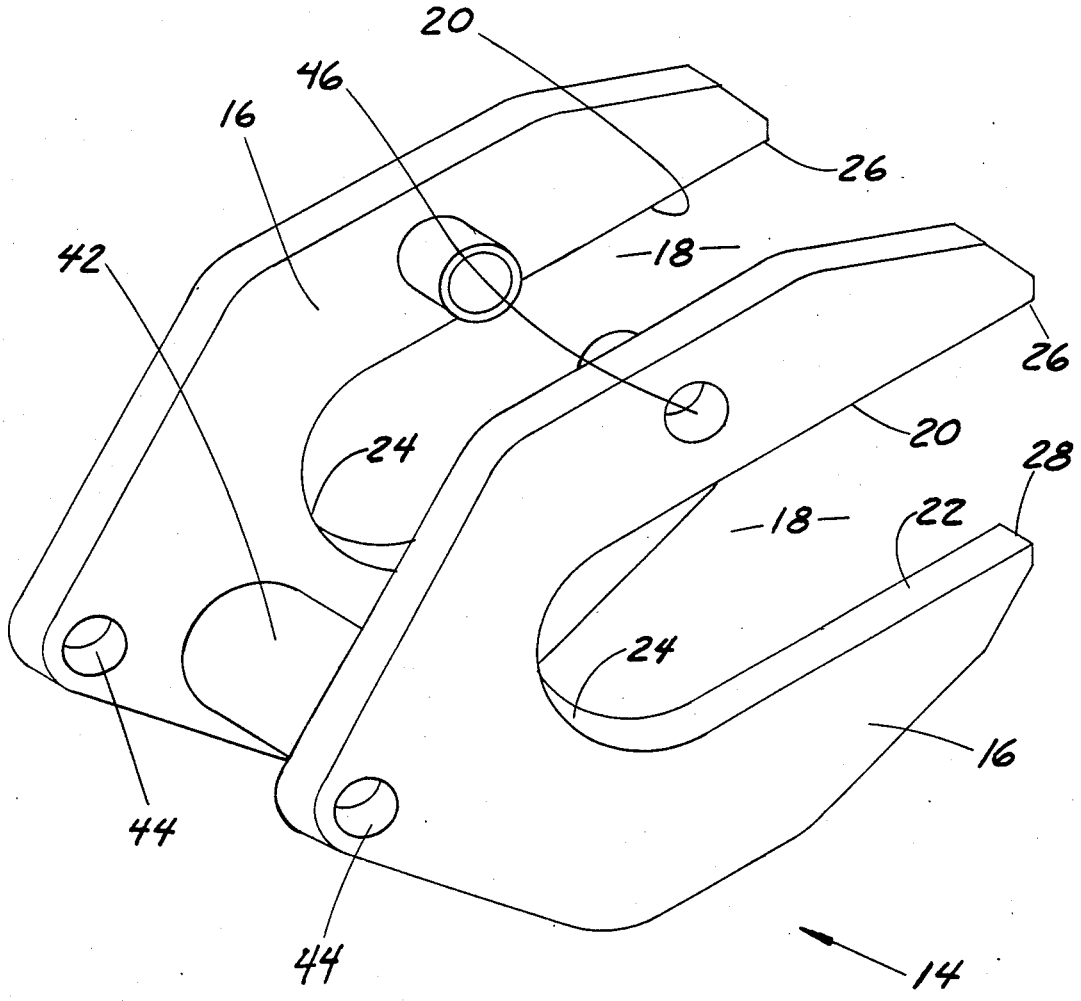
FIG. 5 is a perspective view of another highly preferred embodiment of this invention.

FIGS. 1–4 illustrate a concrete-breaking/removing device 10 having a single slab-engaging member 12. FIG. 5 illustrates a concrete breaking/removing device 14 having a pair of slab-engaging members 16. In describing these two preferred embodiments of the invention, like elements will be identified by the same numbers.

Single engagement member 12 of concrete breaking device 10 has a slab-receiving slot 18, which is generally horizontal during use. Slot 18 is bounded by upper and lower opposed edges 20 and 22, respectively, and a crotch edge 24 between upper and lower edges 20 and 22. Engagement member 12 is a sturdy planar piece of steel.

The upper, lower and crotch edges 20, 22 and 24 are in fixed relative positions. Upper edge 20 and lower edge 22 extend forwardly from crotch edge 24 to terminate in upper and lower forward ends 26 and 28, respectively. Forward ends 26 and 28 are in vertical alignment when slot 18 is in a horizontal orientation.

A mounting bracket 30 is attached to engagement member 12 at a position rearwardly of crotch edge 24. Bracket 30 is a U-shaped member dimensioned for mounting in place of a backhoe bucket. Bracket 30 has two parallel portions having two apertures 34 in alignment for pivot mounting on the main arm 35 of a backhoe, and concrete breaking device 10 pivots around such mounting.

Figure 2:
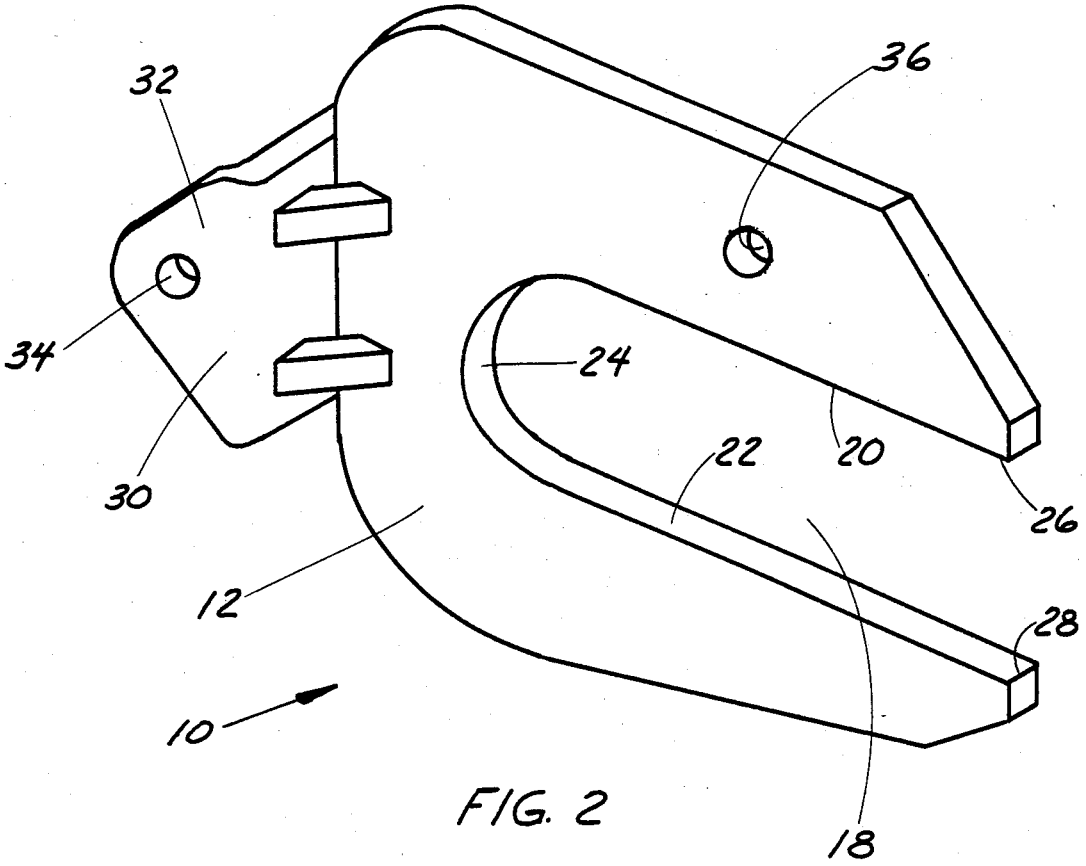
FIG. 2 is a perspective view of the concrete breaker shown in FIG. 1.
Figure 1:
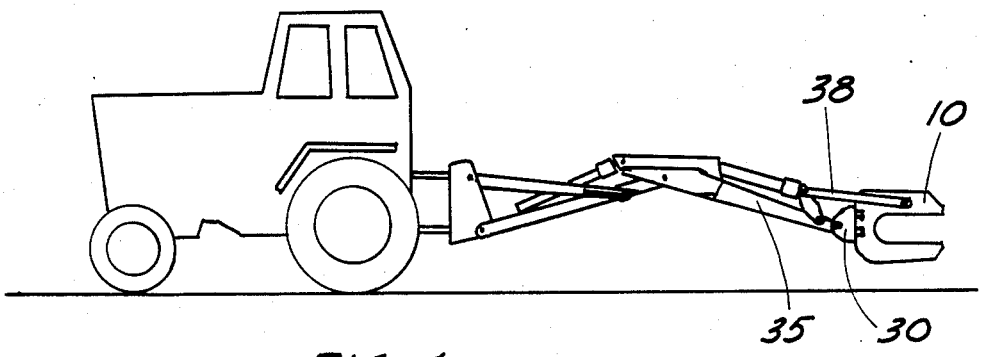
FIG. 1 is a side elevation of a backhoe the bucket of which has been replace by a concrete breaking device in accordance with this invention.
Figure 4:
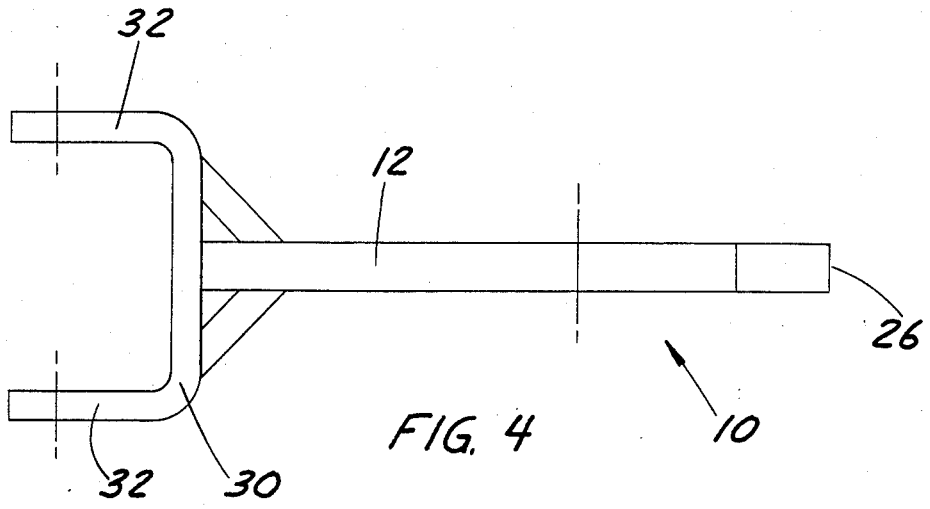
FIG. 4 is a top plan view of FIG. 3.
Figure 3:
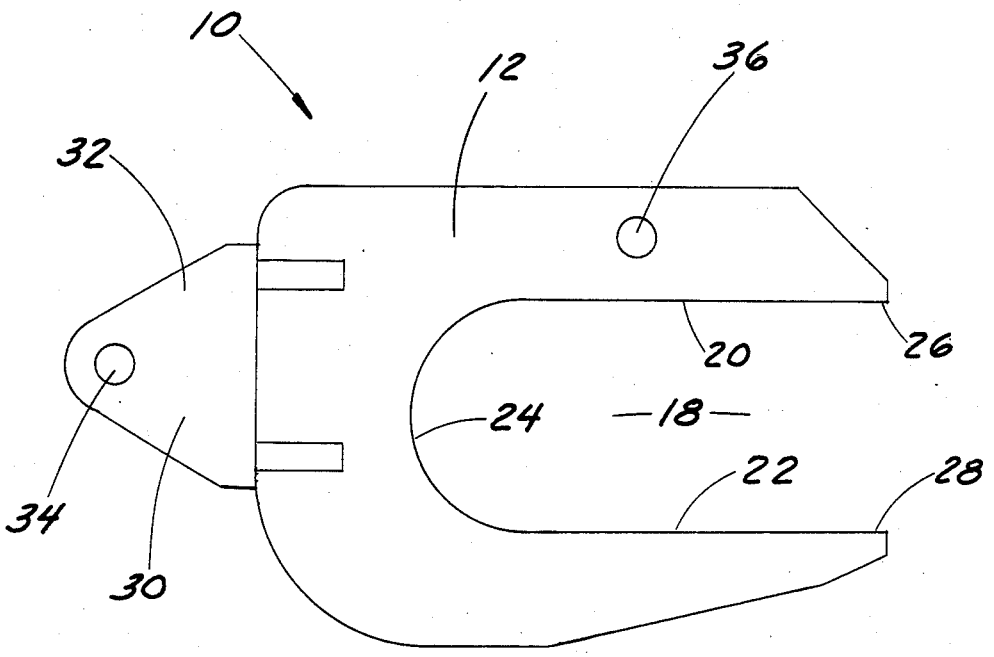
FIG. 3 is a side elevation of FIG. 2.

An aperture 36 which is above upper edge 20 and forward of apertures 34 provides a second pivot-mounting means. As illustrated in FIG. 1, an hydraulic extension member 38 is attached to engagement member 12 at aperture 36. The extention and retraction of hydraulic member 38 changes the orientation of engagement member 12, either tipping slot 18 downwardly from the horizontal or upwardly from the horizontal.

After a concrete slab has been received into slot 18, the orientation of engagement member 12 can be changed and, with or without forward motion of engagement member 12, such action will tend to break up the slab. After the slab is broken, broken pieces may be lifted in engagement member 12 in the manner which will be described herein to be loaded onto a truck for removal or to be placed to the side.

The dimensioning of slot 18 is important to the versatility of the device of this invention.

In concrete breaker 10, the distance between crotch edge 24 and ends 26 and 28 is about twice the spacing between upper and lower edges 20 and 22. The depth of slot 18 is such that a concrete slab member can be supported therein by its own weight for lifting during removal of slabs or broken slab pieces. In such supporting of a piece of concrete slab, the center of gravity of the concrete slab is beyond forward ends 26 and 28 so that lower forward end 28 becomes a fulcrum point and upper edge 20 restrains the slab from tilting to such an extent that it would not fall out of slot 18.

The spacing between parallel upper and lower edges 20 and 22 must be sufficient to receive a concrete slab, but not so wide as to frustrate the binding action just described. For example, a spacing of approximately eight inches and a slot depth of approximately 16 inches are highly desirable for breaking and lifting slabs of various normal thicknesses. Changing these dimensions could accommodate slabs having unusual thicknesses.

The depth of slot 18 should exceed the spacing between upper and lower edges 20 and 22. It is preferably more than one-and-a-half times such spacing and most preferably about twice such spacing, or more. If the thickness of a concrete slab to be removed is only slightly less than the spacing between upper and lower edges 20 and 22, slot 18 need not be as deep as is otherwise desirable. However, the preferred slot depths and relative dimensions will allow the lifting of concrete slabs of widely varying thicknesses.

Concrete breaking/removing device 14, illustrated in FIG. 5, has two engagement members 16 which are joined together by cross-member 42. Cross-member 42 holds engagement members 16 in parallel aligned positions with their slots 18 in parallel alignment.

Apertures 44, which are located to the rear of crotch edges 24, serve as a first pivot-mounting means, for attachment to the main arm of the backhoe or other power tool which controls it. Apertures 46 are above upper edges 20 of slots 18, and provide a second pivot-mounting means for attachment to an hydraulic extension member of the backhoe or other equipment. Apertures 46 are used for the attachment which controls the orientation of concrete breaking device 14.

Concrete breaking device 14 is particularly useful in removal of concrete slabs because it provides two engagement points to support a slab. The "can-opener"action previously described is also very effectively and efficiently carried out with concrete breaking device 14.

In the slab-engaging members of this invention, the bottom edges are preferably tapered to narrow ends, as shown in the figures. This facilitates insertion under a concrete slab.

While the principles of this invention have been described in connection with specific embodiments, it should be understood clearly that these descriptions are made only by way of example and are not intended to limit the scope of this invention.

What is claimed is:

1. In a device for breaking and removing concrete payment of the type having means for engaging opposed surfaces of pavement slabs of any thickness thinner than a predetermined dimension, the improvement comprising:

an engagement member having a forward-opening slab-receiving slot bounded by upper and lower opposed edges and a crotch edge therebetween in fixed relative positions, said upper and lower edges being spaced by more than said predetermined dimension and extending forwardly from the crotch edge to terminate in substantially aligned upper and lower forward ends, the distance between the crotch edge and the ends exceeding the spacing between the upper and lower edges;

first and second pivot-mounting means on the engagement member at positions rearward of said ends, said second means being above the upper edge of the slot and above and forward of the first pivot-mounting means; and a pair of vehicle-mounted support and control arms attached to the first and second pivot-mounting means, respectively, and extending therefrom in a rearward direction.

2. The device of claim 1 wherein the first pivot-mounting means is rearward of the crotch edge.

3. The device of claim 1 wherein the engagement member comprises a substantially planar vertical member forming the upper, lower and crotch edges and a mounting member attached thereto rearwardly of the crotch edge, said first pivot-mounting means being on the mounting member.

4. The device of claim 3 wherein the mounting member is a bracket dimensioned for replacement mounting on power equipment.

5. The device of claim 1 wherein the distance exceeds one-and-a-half times the spacing.

6. The device of claim 5 wherein the distance is about twice the spacing.

7. The device of claim 1 wherein the upper and lower edges are substantially parallel.

8. The device of claim 1 wherein the crotch edge is substantially semi-circular.

9. A device for breaking and removing concrete payment slabs of any thickness thinner than a predetermined dimension comprising:

a pair of substantially planar vertical slab-engaging members having a forward-opening slab-receiving slot bounded by upper and lower opposed edges and a crotch edge therebetween in fixed relative positions, said upper and lower edges being spaced by more than said predetermined dimension and extending forwardly from the crotch edge to terminate in substantially aligned upper and lower forward ends, the distance between the crotch edge and the ends exceeding the spacing between the upper and lower edges;

cross-member means holding the pair of slab-engaging members in fixed spaced position with their slots in substantially parallel alignment;

first and second pivot-mounting means on the slab-engaging members at positions forward of said ends, said second pivot-mounting means being positioned above the slot upper edges and forward of the first pivot-mounting means; and a pair of vehicle-mounted support and control arms secured with respect to the first and second pivot-mounting means, respectively, and extending therefrom in a rearward direction.

10. The device of claim 9 wherein the first pivot-mounting means is rearward of the crotch edge.

11. The device of claim 9 wherein the distance exceeds one-and-a-half times the spacing.

12. The device of claim 11 wherein the distance is about twice the spacing.

13. The device of claim 9 wherein the upper and lower edges are substantially parallel.

14. The device of claim 1 wherein the crotch edges are substantially semi-circular.

* * * * *